US006932087B1

(12) United States Patent
Burns

(10) Patent No.: US 6,932,087 B1
(45) Date of Patent: Aug. 23, 2005

(54) MOUTHGUARDS

(75) Inventor: Peter John Burns, Artarmon (AU)

(73) Assignee: Signature Mouthguards PTY Limited, New South Wales (AU)

( * ) Notice: Subject to any disclaimer, the term of this patent is extended or adjusted under 35 U.S.C. 154(b) by 142 days.

(21) Appl. No.: 10/089,359

(22) PCT Filed: Sep. 26, 2000

(86) PCT No.: PCT/AU00/01166

§ 371 (c)(1),
(2), (4) Date: Jun. 10, 2002

(87) PCT Pub. No.: WO01/22900

PCT Pub. Date: Apr. 5, 2001

(30) Foreign Application Priority Data

Sep. 27, 1999 (AU) ..... PQ3121

(51) Int. Cl.[7] ..... A61C 5/14
(52) U.S. Cl. ..... 128/859; 128/861; 128/862
(58) Field of Search ..... 128/846, 848, 128/859–862; 602/902; 433/6

(56) References Cited

U.S. PATENT DOCUMENTS

| | | | | |
|---|---|---|---|---|
| 3,307,222 A | | 3/1967 | Baldwin et al. | |
| 3,429,045 A | | 2/1969 | Anderson et al. | |
| 4,270,892 A | * | 6/1981 | Faunce | 425/388 |
| 4,848,365 A | | 7/1989 | Guarlotti et al. | 128/859 |
| 5,175,008 A | * | 12/1992 | Ueno | 425/178 |
| 5,228,456 A | * | 7/1993 | Karg | 128/837 |
| 5,692,894 A | | 12/1997 | Schwartz et al. | 433/6 |

FOREIGN PATENT DOCUMENTS

| | | |
|---|---|---|
| WO | 9523013 | 8/1995 |

* cited by examiner

*Primary Examiner*—Michael A. Brown
(74) *Attorney, Agent, or Firm*—Ladas & Parry LLP

(57) ABSTRACT

A method to form a mouthguard, said method including the steps of providing a mould (14) to which a mouthguard shell (16) is applied. A sheet member (21) of resilient material is applied to the shell (16) and plastically deformed by applying a pressure differential across the sheet to thereby urge the shell (16) into contact with the mould (29) to plastically deform the shell (16) to form a mouthguard.

12 Claims, 4 Drawing Sheets

MOUTHGUARDS

TECHNICAL FIELD

The present invention relates to mouthguards and more particularly, but not exclusively, to mouthguards used by sport participants.

BACKGROUND OF THE INVENTION

Mouthguards have consisted of a number of types, including those constructed of thermoplastics material, which are heated (typically in hot water) and then applied to the user's mouth so that the mouthguard is moulded to fit the user's teeth and jaw. A more expensive type of mouthguard is as provided generally by dentists. The dentist "custom fitted" mouthguards are manufactured from an impression taken of the user's teeth and jaw. A sheet of plastics material is placed over the impression and plastically deformed thereto by the use of heat and pressure.

The custom fitted mouthguards discussed above suffer from the disadvantage that there is not incorporated within the mouthguard features desirable for improving the level of protection for the user.

OBJECT OF THE INVENTION

It is the object of the present invention to overcome or substantially ameliorate the above disadvantage.

SUMMARY OF THE INVENTION

The present invention is a method to form a mouthguard to be worn by a user, the method includes the steps of:

- providing a mould having a portion configured as a reproduction of a portion of a user's mouth;
- locating on the mould a mouthguard shell to be plastically deformed by pressure to conform to said portion;
- placing over the shell a deformable sheet so that the shell is located between the sheet and mould; and
- applying a pressure differential across the sheet so that the sheet urges the shell against the mould to plastically deform the shell against said portion so that the mouthguard conforms to the configuration of the user's mouth.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENT

Figure 1:
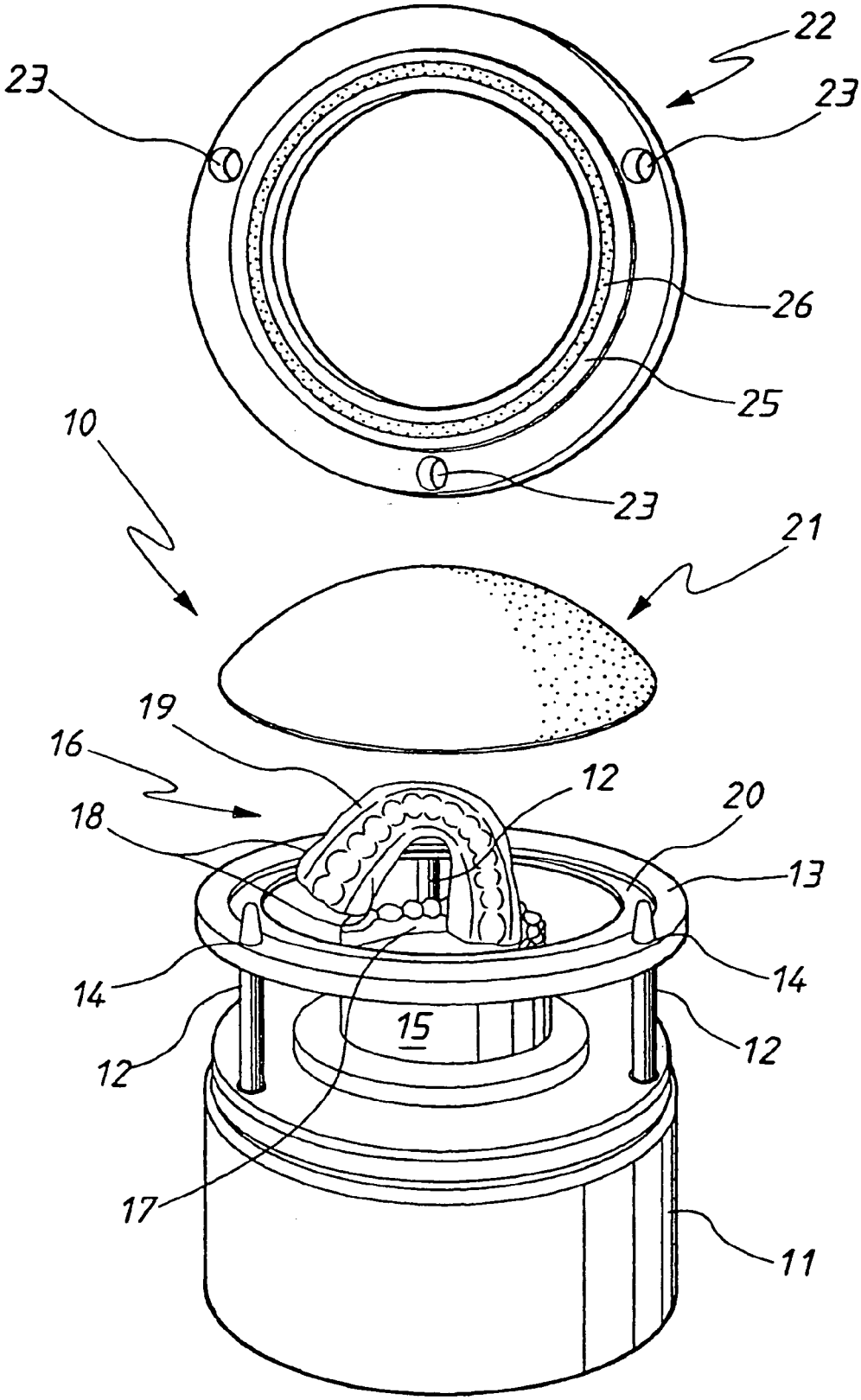
FIG. 1 is a schematic perspective view of an apparatus to deform a mouthguard shell to the configuration of a mould.

Described in International Patent Application PCT/AU99/00458 are a number of mouthguard shells (bodies) which can be plastically deformed so as to conform to the configuration of a user's mouth. The mouthguard shells disclosed in this international patent application may be employed in the apparatus 10 of FIGS. 1 to 3. However, in this respect it should be appreciated that the mouthguard shell described herein is formed from a suitable mouldable material and need not be a shell as described in the above PCT application.

In the accompanying drawings there is schematically depicted an apparatus 10 within which a mouthguard is formed. The apparatus 10 includes a base 11 from which there upwardly extends three posts 12. Inserted over the posts 12 is a sealing ring 13 which has apertures 14 through which the posts 12 pass.

The base 11 receives a mould 29 to deform the mouthguard shell 16. The mould 15 has a portion 17 produced from an impression taken from a patient's mouth, particularly the teeth and gums.

The mouthguard shell 16 is of a "C" configuration and is of a "U" transverse cross section. Typically, the mouthguard shell 16 would have the shape and configuration as illustrated in the above-mentioned PCT specification. The mouthguard shell 16 would fit over the portion 17 so that the portion 17 is located between flanges 18 of the shell 16 and would in particular engage base 19 of the shell 16 to cause deformation thereof so that the mouthguard shell 16 conforms to the shape and configuration of the portion 17.

Typically, the shell 16 would be heated prior to being placed on the portion 17, so that when pressure is applied to the shell 16, the shell 16 plastically deforms. To apply pressure to the shell 16 there is provided a sheet member 21 formed of resilient material such as plastics or rubber material. In this embodiment the sheet member 21 is of a circular configuration so as to rest on the annular lip 20. To maintain the sheet member 21 in sealing contact with the ring 13 there is provided a clamp ring 22 which is of a similar configuration to the ring 13. The ring 22 has apertures 23 through which the posts 12 pass.

Figure 2:
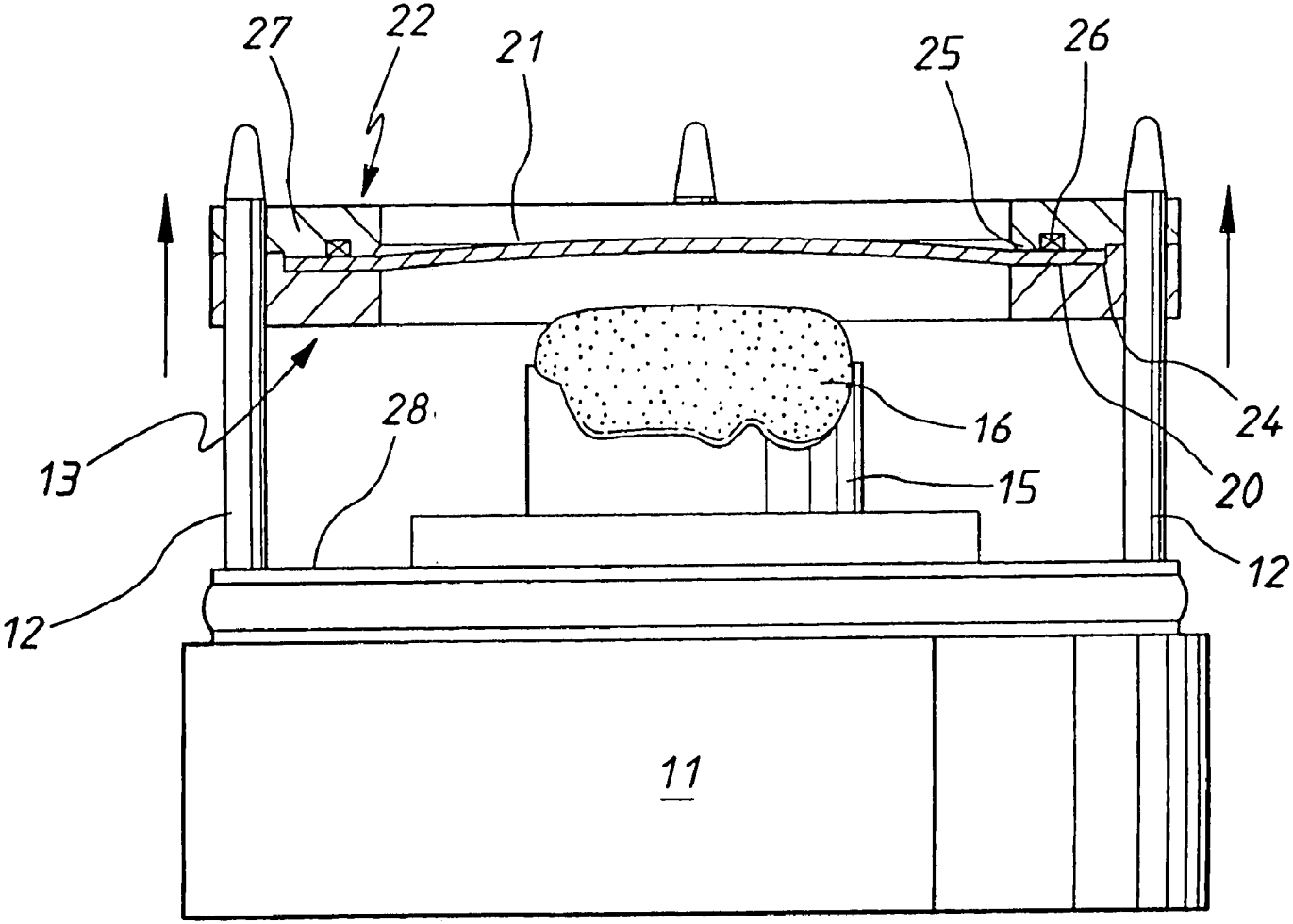
FIG. 2 is a schematic part section side elevation of the apparatus mould and mouthguard shell of FIG. 1, in a first configuration.
Figure 3:
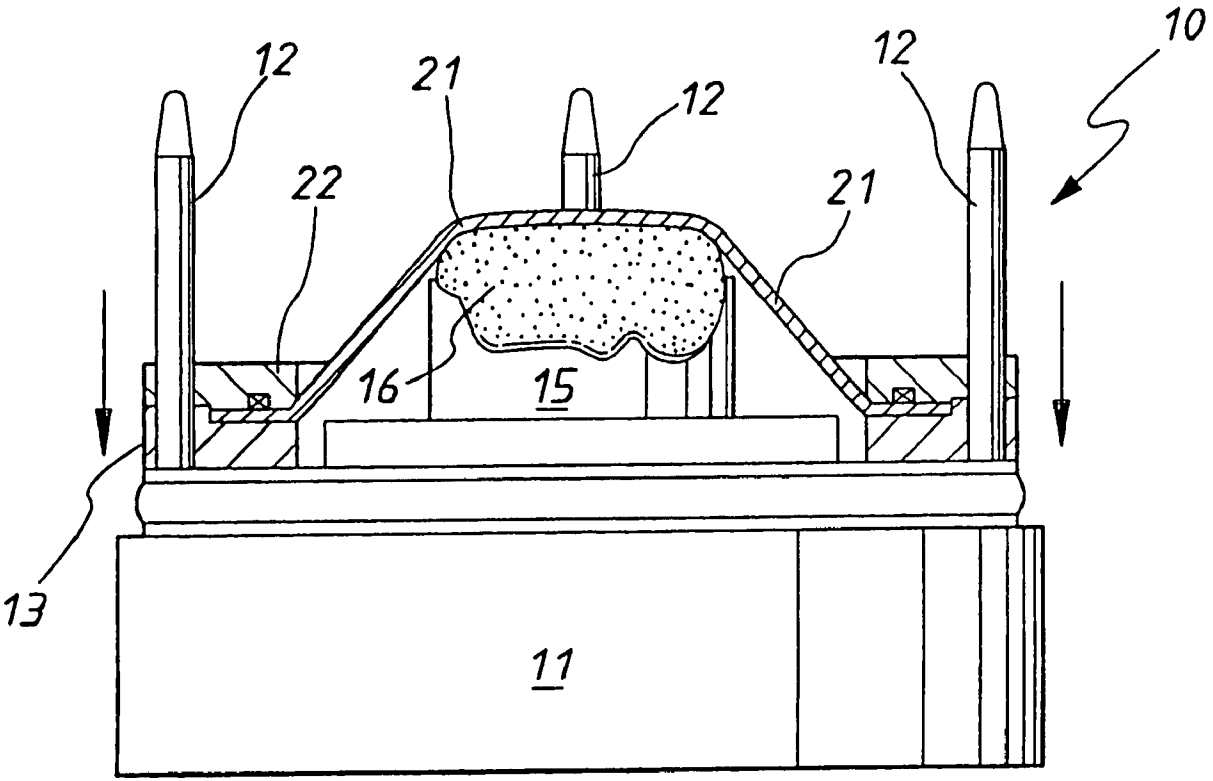
FIG. 3 is a schematic part section side elevation of the apparatus, mould and mouthguard shell as illustrated in FIG. 2 in a further configuration.
Figure 5:
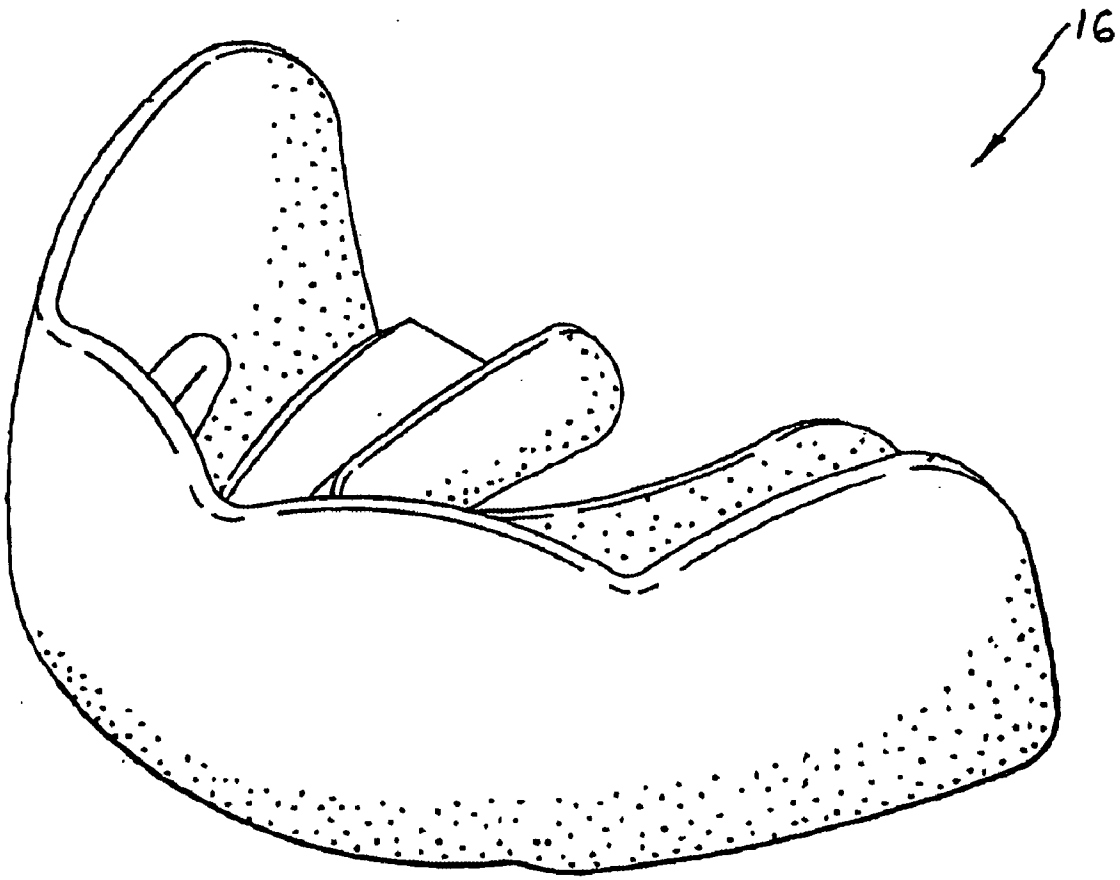
FIG. 5 is an isometric view of the mouthguard shell of FIG. 1.

The ring 13 has an annular step 24 providing the lip 20. As best seen in FIGS. 2 and 3 the member 21 is engaged within the step 24.

The ring 23 has an annular projection 25 which is of a configuration to cooperate with the step 24 so that the member 21 has its annular periphery clamped between the rings 13 and 22. If so required the ring 22 can be provided with a sealing ring 26.

When the mouthguard shell 16 is to be deformed to form a mouthguard for the patient from which the impression has been taken, the shell 16 is heated and then placed on the portion 17. The apparatus 10 with the shell 16 is then placed in a machine which applies a pressure differential across the member 21. More particularly the machine includes a piston that engages with the upper surface 27 of the ring 22 and moves the rings 13 and 22 down into contact with the surface 28 of the base 11. The piston sealingly engages the surface 27 and applies a gas (preferably air) under pressure to the upper surface of the member 21. The member 21 then deforms about the shell 16 and forces the shell 16 onto the portion 17 to plastically deform the shell 16. The pressure above the member 21 is released and the rings 13 and 22 raised so that an operator may then remove the formed mouthguard.

In an alternative embodiment the rings 13 and 22 may be moved into contact with the surface 28 and then air withdrawn from below the member 21 so that air pressure above the member 21 exerts a force on the shell 16 to deform the shell 16.

Figure 4:
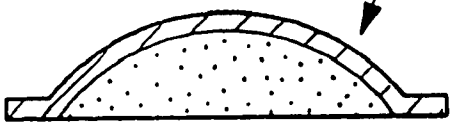
FIG. 4 is a schematic section side elevation of an alternative sheet member employed in the apparatus of FIG. 1.

In an alternative embodiment the member 21 may be preformed so as to be convex as illustrated in FIG. 4. This would aid in minimising or eliminating forces generated by stretching the member 21 over the shell 16. In such an arrangement only the pressure differential across the member 21 would cause deformation of the shell 16.

In the above described preferred embodiments the member 21 may be rubber, latex, silicone or any other suitable synthetic elastomeric material. In the above embodiment the member 21 is of a domed configuration. The member 21 is domed so as to extend away from the mould 15 (see FIGS. 1 and 4). In an alternative embodiment, the member 21 may be formed of elastic foil.

What is claimed is:

1. A method to form a mouthguard to be worn by a user, the method includes the steps of:

providing a mould having a portion configured as a reproduction of a portion of a user's mouth;

locating on the mould a mouth guard shell to be plastically deformed by pressure to conform to said portion;

placing over the shell a deformable sheet so that the shell is located between the sheet and mould; and applying a pressure differential across the sheet so that the sheet urges the shell against the mould to plastically deform the shell against said portion so that the mouthguard conforms to the configuration of the user's mouth, wherein the sheet is of a domed configuration prior to the deformation.

2. The method of claim 1 wherein the sheet has a shell side and a remote side, with the pressure on said remote side being increased to urge the shell against the mould.

3. The method of claim 2 wherein said sheet is formed of natural of synthetic rubber, latex, silicone or elastic foil.

4. The method of claim 2 wherein said sheet is flat prior to the deformation.

5. The method of claim 1 wherein said sheet has a shell side and a remote side, with the pressure on said shell side being reduced to urge the shell against the mould.

6. The method of claim 5 wherein said sheet is formed of natural of synthetic rubber, latex, silicone or elastic foil.

7. The method of claim 5 wherein said sheet is flat prior to the deformation.

8. The method of claim 1 wherein said sheet is formed of natural synthetic rubber, latex, silicone or elastic foil.

9. The method of claim 8 wherein said sheet is flat prior to the deformation.

10. The method of claim 1 wherein said sheet is flat prior to the deformation.

11. The method of claim 1 wherein said sheet is maintained at a spaced location relative to the shell prior to the deformation, and is subsequently moved towards said shell to cause initial elastic defamation of the sheet prior to applying said pressure differential.

12. A mouthguard formed by the method of claim 1.

* * * * *